United States Patent [19]

Jacoby

[11] 4,272,128

[45] Jun. 9, 1981

[54] METHOD OF CREATING A SAFE ENVIRONMENT IN SALT MINING

[76] Inventor: Charles H. Jacoby, 959 E. Driftwood Dr., Tempe, Ariz. 85283

[21] Appl. No.: 116,930

[22] Filed: Jan. 30, 1980

[51] Int. Cl.[3] ..... E21C 41/08

[52] U.S. Cl. ..... 299/12; 299/16; 299/1; 166/308

[58] Field of Search ..... 299/12, 16, 1; 166/308; 175/41, 50, 210

[56] References Cited

U.S. PATENT DOCUMENTS

| | | | |
|---|---|---|---|
| 2,206,922 | 7/1940 | Smith | 175/41 |
| 3,302,706 | 2/1967 | Thompson et al. | 175/50 X |
| 3,384,416 | 5/1968 | Ruehl et al. | 299/16 |
| 3,650,564 | 3/1972 | Williamson | 299/12 |
| 3,814,480 | 6/1974 | Dahl et al. | 166/308 X |
| 3,934,649 | 1/1976 | Pasini et al. | 299/12 |

FOREIGN PATENT DOCUMENTS

| | | | |
|---|---|---|---|
| 1273469 | 7/1968 | Fed. Rep. of Germany | 299/16 |
| 1342998 | 1/1974 | United Kingdom | 299/12 |

OTHER PUBLICATIONS

"Degasifying Before Mining," Coal Age, Aug. 1961, pp. 74–78.

*Primary Examiner*—Ernest R. Purser

*Attorney, Agent, or Firm*—Bean, Kauffman & Bean

[57] ABSTRACT

There is disclosed a method for more safely conducting an underground mechanical mining operation such as typically employs successive drilling, blasting, and product removing processes against a mine work face which is conducted from within an open mine room or the like in an underground deposit of salt. Such materials are per se impervious to fluid transmission therethrough but as they occur in underground deposits vicariously include pockets of or channels for outlet from traps of pressurized fluid accumulations, such as would be dangerous to the mining operation if inadvertently encountered incidental to the routine drilling and blasting processes. The method features, prior to each routine working face drilling and blasting operation; creating a safe environment therefor by first boring one or more exploratory hole(s) through means of a pressure-sealed casing into the salt deposit ahead of the mine working face to a depth beyond the region into which the subsequent mine face drilling and blasting operation is to be performed. The detritus from the boring operation is analyzed to detect evidence of any dangerous sources environmental to the projected mining operation. The bore hole is then "mini-fractured" at an analysis-determined optimum depth therein to monitor the environment in order to insure the safety of the subsequently to be performed routine mining operation.

9 Claims, 5 Drawing Figures

METHOD OF CREATING A SAFE ENVIRONMENT IN SALT MINING

BACKGROUND OF THE INVENTION

Field of the Invention and its Purpose

Present-day mechanical salt mining operations are typically conducted by sequential work face drilling; blasting; and broken salt removal operations. However, on occasion the blasting operations have been known to release pressurized fluid and/or ignite combustible liquid or gas accumulations existing behind the working face with disastrous results to the mining crew. Such accumulations may occur in cavities, or in fault fissures, or in porous stria; or in the form of hydrocarbon inclusions occurring along with recrystallized salt fillings of previously formed crevices or cavities in the salt deposit.

Such anomalies are for example especially frequent within a salt "dome"; and it is believed that these are due to the fact that following upthrust formation of the dome and progressive emergence of the enlarged upper portion thereof through a decreasing pressure gradient in the country rock, the peripheral compression forces of the country rock against the dome correspondingly relax. Also, incident to upthrusting formation of the salt dome, the peripheral walls of the surrounding country rock are lifted and inclined upwardly towards the dome, thereby providing permeable zones in the country rock around the dome into which liquid and gaseous hydrocarbons tend to accumulate. Many successful oil and/or gas producing wells are based upon such accumulations.

Although the solid salt per se of such deposits is impermeable to transmission of gas/liquid materials therethrough, it is known that faults, fractures, and open fissures do occur in such domes as explained hereinabove. Such passageways usually extend in vertical or near vertical attitudes and in plan view predominantly either concentrically or straight-line transversely of the dome; and it is found in some cases that hydrocarbon liquids/gases originally occurring in the circumjacent country rock (being squeezed under tremendous pressures) have migrated/infiltrated and/or settled into these fissures or conduits within the body of the salt dome.

This invention relates to a method of insuring/creating a safe operational environment within typical mechanically (dry) mining salt deposit operations; and more particularly to a method for more safely mining such salt deposits having hazardous fluid accumulations occasionally entrapped therein; such as occur by way of example in the "dome" or "diapir" type salt deposits of the Texas-Louisiana Coastal Basin, and/or in the Gulf region of the United States and Mexico. It is also to be understood, however, that the method of the invention is similarly applicable to the mining of potash, trona, and other such evaporite deposits.

The primary object of the invention is to provide a method which will preclude inadvertent triggering of disastrous explosions and/or "blow-outs" from the mine working face with consequent loss of life such as for example was recently experienced in a Louisiana State salt dome mining operation. Incidentally thereto, the invention also contributes to the fracturing and/or "dilation" to a lesser degree of the solid salt mass ahead of the mine face which is to be mined; thereby reducing the powder consumption cost of the subsequent mining operation.

SUMMARY OF THE INVENTION

The invention involves first drilling one or more bore holes into the salt deposit ahead of or in the direction of the advancements of a mine working face prior to each mine face drilling and blasting operation, and into the region beyond which it is intended to penetrate. The exploratory bore hole(s) is/are drilled through a casing which is cemented or otherwise sealed into the solid salt deposit; and the drilling rig operates through a gas-pressure sealed casing which is braced against displacement away from the mine face. The bore hole is mini-fractured at a depth therein optimumly guided for discovery of a dangerous geologically ambient environment by analysis of the detritus from the bore hole at various stations linearly therealong. The casing system is provided with means for controlling release of any encountered pressurized fluid occurrences preliminary to the subsequently to be performed routine mine face drilling/blasting operations.

SPECIFICATION AND DESCRIPTION OF THE PREFERRED EMBODIMENTS

Figure 1:
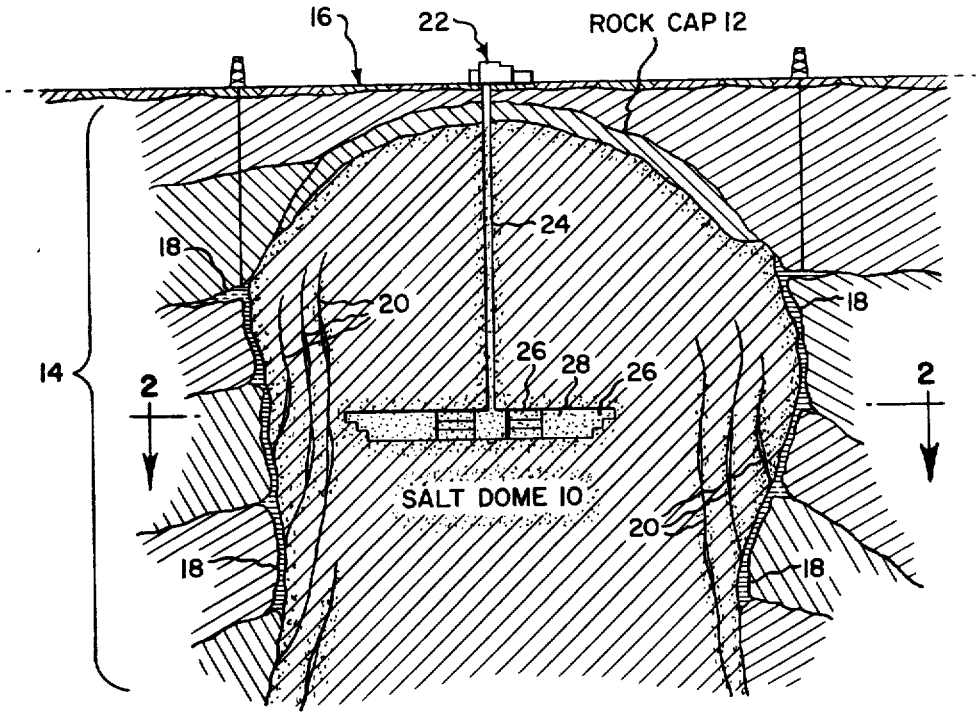
FIG. 1 is a fragmentary, vertical, geological, sectional view through the upper portion of a typically configured salt dome such as occur in the Texas-Louisiana-Gulf region of the United States; illustrating typical salt dome circumjacent country rock piercement and uplift results; salt dome faulting; and a typical room and pillar mining operation in the salt dome.
Figure 2:
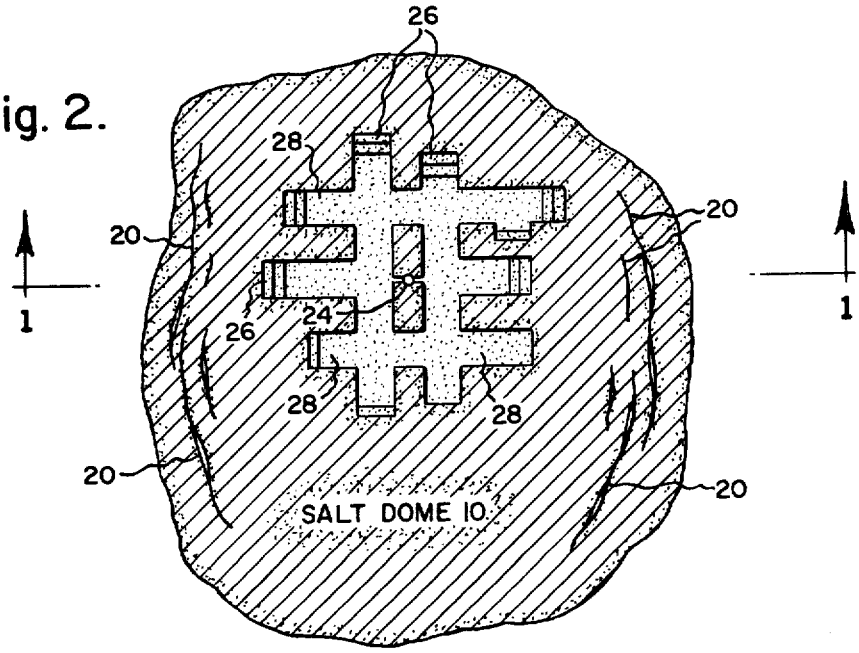
FIG. 2 is a horizontal sectional view taken as along line 2—2 of FIG. 1.

As shown in FIGS. 1, 2, a typically configured salt dome is illustrated at 10, surmounted by a cap rock 12. The dome is shown as having emerged upwardly through layers of country rock 14 to an elevation just below the earth's surface 16. It is well known that the peripheral walls of the country rock through which such domes have been extruded or erupted are uplifted and made structurally permeable during the process, thereby providing porous zones or beds therein inclining upwardly towards the dome through which initially deposited fluidic hydrocarbons and/or other light fluids contained therein tend to migrate and to accumulate into the elevated perimeters of the country rock strata, as are illustrated for example herein at 18. Typical occurrences of fault zones in the salt dome as discussed hereinabove are also illustrated by way of example at 20; and it is to be noted that these faults in many cases extend into communication with accumulations such as are illustrated at 18. Reference in this respect is made to "Salt Domes—Gulf Region, United States and Mexico" by Michael T. Halbouty, published in 1967 by Gulf Publishing Company of Houston, Tex. at pages 66–68; 75–93. Also see "Sodium Chlorid—The Production and Properties of Salt and Brine", edited by Dale W. Kaufmann; American Chemical Society Monograph Series, published by Hafner Publishing Company, Inc. in 1968, at pages 14, 114–124.

Further by way of example, a typical salt dome mining operation is illustrated at FIGS. 1, 2 herein to include a head frame and a surface plant 22; the vertical shaft down into the dome being shown at 24; the horizontal mine headings therefrom being shown at 26; and the sidewise extending rooms being shown at 28. As is well known, in the case of such mines the rooms are typically worked by the "multi-bench" method; whereby the "face" of the uppermost bench thereof as shown at 30 is horizontally the furthest advanced heading. This work face is initially undercut; and blast holes are then drilled into the face and are then "shot" by explosives. The lower benches of the advancing room are then vertically drilled and blasted sequentially to facilitate removal of the broken salt products. It is incidental to these blasting operations, especially when working the upper headings, which at that point in time involves the deepest penetration of the virgin salt mass, that the possibility of a "mine explosion" exists because the routine drilling and blasting operations may on occasion intercept a dangerous fluid-occupied zone in the salt body, as explained hereinabove.

The present invention contemplates an improved method by which exploration for the presence of entrapped pressurized dangerous fluid sources in the salt deposit behind the working face to be drilled into is conducted prior to drilling and blasting the room face. It is noteworthy that fluid-including sources occurring behind the face may or may not be continuous in planes opposing/intersecting the probing operations. Therefore, in accordance with this invention, prior to the blasting hole drilling operations, an exploratory bore hole as shown at 35 is first drilled into the face of the working to a depth beyond the depth to which the subsequent blast hole drilling operations are to be conducted. If no pressurized fluid source indication is encountered by this first bore hole although the existence thereof is suspect, several more exploratory holes may be drilled into the face, as will be more fully explained hereinafter.

Figure 3:
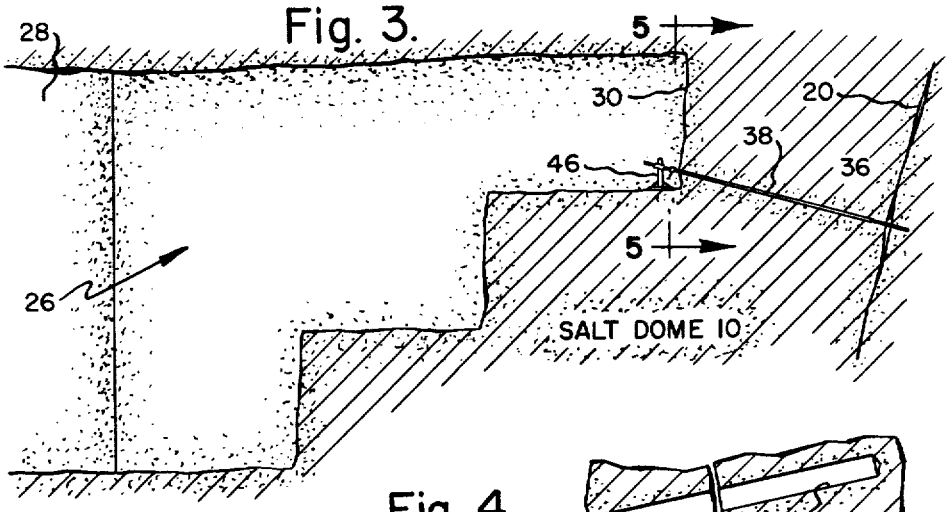
FIG. 3 is a vertical sectional view illustrating a pressurized fluid source probing operation of the present invention.
Figure 4:
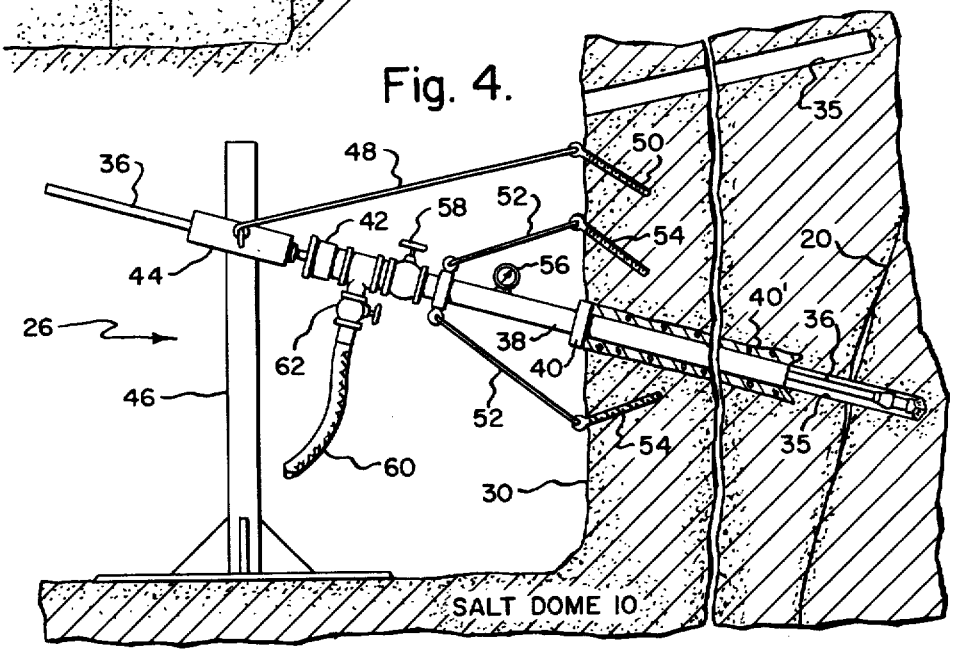
FIG. 4 is an enlarged scale fragmentary view of the probing operation of FIG. 3.

In accordance with this invention the probing operations may be performed as shown herein by way of example by means of a drill bit 36 operating through a casing 38 which is sealed and anchored into the soid salt body by a suitable packer or expanding cement such as is indicated at 40; the casing 38 being also pressure-sealed externally of the working face relative to the drilling machine such as by means of a stuffing box 42. The drilling machine such as is schematically indicated at 44 may be mounted on any suitable tripod support 46 or the like, and anchored against any rearward displacement relative to the mine face as by means of cables 48 and anchor bolts 50 as shown in FIGS. 3, 4. The casing 38 may be similarly anchored to the salt face such as by means of cables 52 and bolts 54.

Thus, if and whenever a pocket or other source of pressurized fluid is encountered by the probing drill bit, it is preferably arranged that the fluid will be entrapped within the rig by ball check valve means within the hollow drill rods 36; such means being well known in the art. A pressure gauge such as shown at 56 on the casing will furnish an indication of the degree of pressure encountered. If the pressure is nominal, it may be gradually and safely disposed of. If the pressure is intense, however, arrangements may be made to pipe the fluid to the surface plant 22 such as for useful purposes. A "full opening" type globe valve as shown at 58 may be employed so that upon withdrawal of the drill rod the pressurized fluid is still confined within the casing; and a by-pass conduit 60 and valve 62 therefor may also be provided to control delivery of drilling fluid and cuttings throughout the drilling operation (as well as any encountered fluid) into a suitably controlled relief system.

Figure 5:
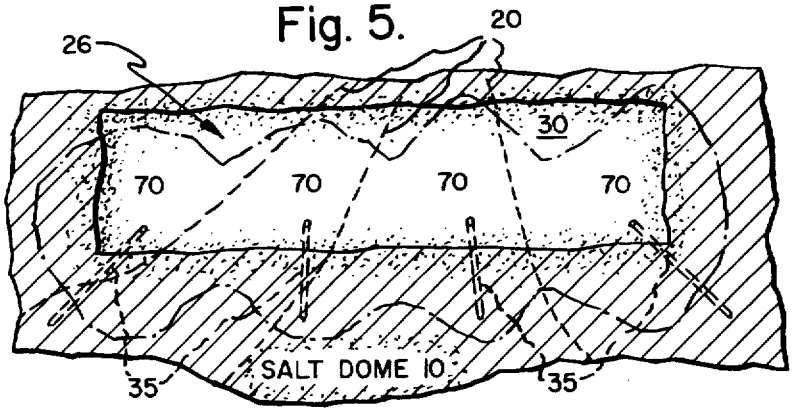
FIG. 5 is a fragmentary vertical sectional view taken as along line 5—5 of FIG. 3; illustrating the effects of mini-fracturing a fluid pocket exploring operation performed in accordance with the invention.

If no pressurized fluid is encountered by the first probe hole, one or more additional probe holes may be drilled into the face at various angles with a view to intersecting any suspected sources such as may not have been encountered by the first probe hole. For example, it is contemplated that although no fluids under pressure may have been encountered by the probe hole(s), if the cuttings and/or cores from the probe hole(s) under ultraviolet light or by chromatographic/spectrophotometric analysis or the like indicate the nearby presence or pressurized hydrocarbons or other fluids or gases, these may furnish "tell-tale" evidences of the nearby existence of fractures, channels, or conduits for fluidic transport from nearby highly pressured zones or traps of such materials. Therefore, in accordance with this invention the probe holes will be "mini-fractured" such as is shown at FIG. 5 under guidance of such analyses, with a view to opening up communication with any such potentially dangerous material sources existing behind the "working face"; for safe disposal thereof as explained hereinabove. In this respect, the bore hole cuttings/cores will in either case be analyzed linearly of the bore hole, and the results utilized to locate for optimum results the linear station within the bore hole for the mini-fracturing operations.

As shown herein, the "probe" operations are preferably performed by drilling into the uppermost heading of the room face because it is ahead of the lower benches of the mining operation; and also because from this vantage point the probing operations may be directed ahead and downwardly of the mine working so as to intersect the salt body ahead of the entire working face format. The "mini-frac" operations referred to above and as are illustrated by way of example at FIG. 5 may readily be performed subsequent to each probe hole drilling operation by utilizing the sealed casing arrangement such as is illustrated at FIG. 4.

The "mini-frac" operations referred to may be performed by any suitable shock-pressure supply processes such as are well known in the art. For example, such processes are disclosed in my earlier U.S. Pat. Nos. 3,064,957; 2,645,291; and 3,822,916. Alternatively, the fracturing may be performed by use of other suitable means, such as by employment of the "Airdox" and/or "Cardox" systems. Accordingly, it is to be understood that the probe hole boring analyzing and fracturing operations will be conducted according to behind-the-work-face conditions such as they may be encountered. Released gas or liquid pressure readings and/or visual or chromatographic studies of the drill cuttings or cores will guide the operator as to adequate exploratory maneuverings.

By way of further example as shown at FIG. 5, if analyses indicate that existence of a dangerous source in the neighborhood is suspected (but so far not encountered), a plurality of probe holes may be driven into the mine face at intervals laterally thereof. As explained hereinabove, each boring operation thereof may be subsequently mini-fractured so as to provide a completely fractured format behind the working face such as is illustrated at 70 (FIG. 5) to eliminate inadvertent incursions of the routine mining processes into a dangerous environment.

As previously referred to, in any case, the exploratory operation ahead of the mine face to be routinely drilled and blasted for production purposes incidental thereto dilates and/or fractures the salt mass ahead of the working zone; and therefore contributes to reduce the costs of the routine blasting operation.

I claim:

1. An improved method for conducting a mechanical mining operation which routinely employs sequential drilling, blasting, and product removing processes against a mine work face, conducted from within a mine room or the like in a deposit of salt which per se is basically impermeable to fluid transport therethrough but which deposit vicariously includes crevices/pockets or the like occupied by pressurized and/or combustible materials such as would be dangerous to the mining operation if encountered incidental to the routine processes of drilling and blasting the mine working face; said improved method comprising:

prior to each routine working face drilling and blasting operation, creating a safe environment for the workmen within said open mine room or the like by first boring an exploratory hole into the salt deposit ahead of the mine working face beyond the region into which said mine face drilling and blasting operation is subsequently to be performed, and dilating/fracturing the salt deposit beyond said mine work face via said bore hole so as to preliminarily discover existence therein of any such pressurized/combustible materials;

controlling release of any said materials as may thereby be encountered so as to create a safe working environment condition for said routine operations;

and then subsequently performing said routine mine face drilling, blasting, and broken salt removal processes under said safe environment condition.

2. The method as set forth in claim 1 wherein said exploratory bore hole is performed by means of a drilling tool operating against and into said face through a fluid-pressure sealed casing.

3. The method as set forth in claim 2 wherein said drilling tool is motivated by a machine disposed within said room or the like externally of said mine face, and is braced against displacement rearwardly therefrom.

4. The method as set forth in claim 2 wherein said bore hole is driven into the upper portion of the mine working face and is inclined downwardly therefrom into the salt body ahead of the mine working face.

5. The method as set forth in claim 1 wherein a plurality of such exploratory bore holes are driven into the mine working face at intervals laterally thereof.

6. The method of mining as set forth in claim 5 wherein said bore holes are drilled into the upper portion of the mine working face, and are inclined downwardly therefrom and forwardly into the salt deposit ahead of the mine working face.

7. The method of mining a salt deposit as set forth in claim 1 wherein the detritus of the bore hole driving operation is analyzed and related linearly of the bore hole and is utilized to ascertain the optimum loci for fracturing the deposit for discovery of environmentally dangerous material sources.

8. The method as set forth in claim 7 wherein said detritus is chromatographically analyzed.

9. The method as set forth in claim 7 wherein said detritus is optically analyzed.

* * * * *